US005626114A

United States Patent [19]

Kushida et al.

[11] Patent Number: 5,626,114

[45] Date of Patent: May 6, 1997

[54] FUEL PUMP FOR HIGH-PRESSURE FUEL INJECTION SYSTEM

[75] Inventors: Takeo Kushida; Hideya Kikuchi; Etsuro Hozumi, all of Saitama Prefecture, Japan

[73] Assignee: Zexel Corporation, Japan

[21] Appl. No.: 566,721

[22] Filed: Dec. 4, 1995

[30] Foreign Application Priority Data

Dec. 7, 1994 [JP] Japan ..... 6-330342

[51] Int. Cl.[6] ..... F02M 37/04; F02B 77/00

[52] U.S. Cl. ..... 123/198 D; 123/511

[58] Field of Search ..... 123/510, 511, 123/506, 459, 514, 198 D

[56] References Cited

U.S. PATENT DOCUMENTS

| | | | |
|---|---|---|---|
| 4,625,701 | 12/1986 | Bartlett et al. | 123/510 |
| 4,872,438 | 10/1989 | Ausiello et al. | 123/510 |
| 5,085,198 | 2/1992 | Bartlett et al. | 123/510 |

*Primary Examiner*—Thomas N. Moulis
*Attorney, Agent, or Firm*—Ostrolenk, Faber, Gerb & Soffen, LLP

[57] ABSTRACT

A fuel pump for a high-pressure fuel injection system includes a high-pressure fuel pump 4 for supplying high-pressure fuel to injectors 8 for injecting high-pressure fuel into cylinders of an engine, a pressure control valve 10 for controlling the fuel pressure of the high-pressure fuel pump 4, a high-pressure fuel supply pipe 16 connecting the high-pressure fuel pump 4 and the injectors 8, a high-pressure fuel control pipe 17 connecting the injectors 8 and the pressure control valve 10, and a pump-control valve communication passage 18 formed to communicate the high-pressure fuel pump 4 with the pressure control valve 10 and bypass the injectors 8, the sectional area of the pump-control valve communication passage 18 being smaller than those of the high-pressure fuel supply pipe 16 and the high-pressure fuel control pipe 17. Owing to the provision of the pump-control valve communication passage 18, the high-pressure fuel pump of the fuel pump for a high-pressure fuel injection system can secure a pressure relief function without separate installation a relief valve.

7 Claims, 3 Drawing Sheets

FUEL PUMP FOR HIGH-PRESSURE FUEL INJECTION SYSTEM

BACKGROUND OF THE INVENTION

1. Field of the Invention

This invention relates to a fuel pump for a high-pressure fuel injection system, more particularly to a fuel pump for a high-pressure fuel injection system with an improved relief valve function.

1. Prior Art

A conventional direct gasoline injection system or other such high-pressure fuel injection system has a high-pressure fuel pump and a pressure control valve (solenoid valve unit) for controlling the fuel pressure, and is further equipped with a relief valve for preventing abnormal pressure rise in the high-pressure fuel pump should the fuel passage be blocked for some reason at or downstream of the discharge port.

Since the relief valve is set to a pressure that is at least 10% higher than normal operating pressure, however, the pump components are subjected to a corresponding overload.

In addition, provision of the relief valve as an add-on component increases costs and also involves the risk that leakage from the relief valve may lower system performance.

This invention was accomplished in light of the foregoing problems of the prior art and has as one of its objects to provide a fuel pump for a high-pressure fuel injection system whose high-pressure fuel pump can secure a relief function without separate installation of a relief valve.

Another object of the invention is to provide a fuel pump for a high-pressure fuel injection system whose pressure control valve for controlling the fuel pressure of the high-pressure fuel pump is provided with a pressure relief function.

Another object of the invention is to provide a fuel pump for a high-pressure fuel injection system whose structure is optimal for providing the pressure control valve with a pressure relief function.

SUMMARY OF THE INVENTION

The present invention is directed to a fuel pump for a high-pressure fuel injection system wherein the high pressure pipe between the high-pressure fuel pump and the injectors is bypassed by a pump-control valve communication passage. The fuel pump for a high-pressure fuel injection system according to the invention comprises a high-pressure fuel pump for supplying high-pressure fuel to injectors for injecting high-pressure fuel into cylinders of an engine, a pressure control valve for controlling the fuel pressure of the high-pressure fuel pump, a high-pressure fuel supply pipe connecting the high-pressure fuel pump and the injectors, a high-pressure fuel control pipe connecting the injectors and the pressure control valve, and a pump-control valve communication passage formed to communicate the high-pressure fuel pump with the pressure control valve and bypass the injectors, the sectional area of the pump-control valve communication passage being smaller than those of the high-pressure fuel supply pipe and the high-pressure fuel control pipe.

The invention further provides a fuel pump for a high-pressure fuel injection system wherein the high-pressure fuel pump and the pressure control valve are integrated into a unitary pump unit and the pump-control valve communication passage is formed in a control valve housing of the pump unit.

The pump-control valve communication passage can be formed with an orifice.

In the fuel pump for a high-pressure fuel injection system according to this invention, since the pump-control valve communication passage is formed to bypass the high-pressure fuel supply pipe from the high-pressure fuel pump to the injectors, the pressure control valve that controls the pressure of the high-pressure fuel pump can itself manifest the pressure relief function of a relief valve, making it possible to relieve abnormal high pressure of the high-pressure fuel pump without separately installing a relief valve.

The cost of the fuel pump for a high-pressure fuel injection system can therefore be reduced by an amount equal to the cost of a relief valve. Moreover, since the pressure control valve differs from a relief valve in that it opens and closes at normal pressure, the pump components are not exposed to an overload.

In addition, since pressure control valves are very precisely adjusted to their rated pressure, the utilization of a pressure control valve for fulfilling the function of a relief valve not only substantially eliminates variance between different high-pressure gasoline pumps that are manufactured but also overcomes the problem of performance degradation owing to fuel leakage from a relief valve.

DETAILED DESCRIPTION OF THE PREFERRED EMBODIMENT

An embodiment of the fuel pump for a high-pressure fuel injection system according to the invention will be explained with reference to FIGS. 1 to 3, taking as an example a fuel pump for a high-pressure fuel injection system 1 which constitutes an application of the invention to a direct gasoline injection system.

Figure 1:
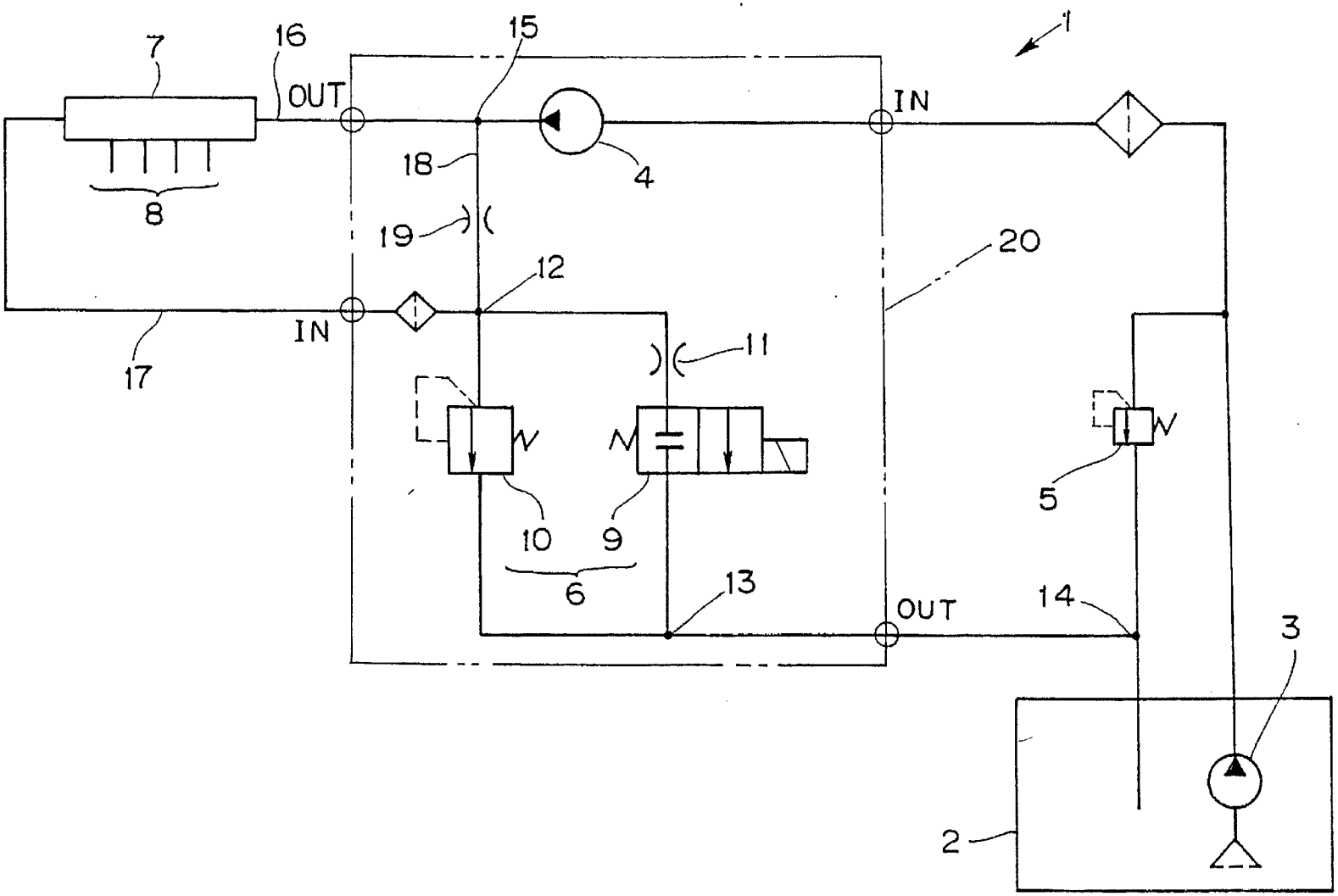
FIG. 1 is a schematic diagram of a fuel pump for a high-pressure fuel injection system 1 that is an embodiment of the invention.

FIG. 1 is a schematic overview of the fuel pump for a high-pressure fuel injection system 1, which, as shown, comprises a fuel tank 2, a low-pressure feed pump (low-pressure fuel pump) 3, a high-pressure gasoline pump (high-pressure fuel pump) 4 having an outlet 15, a low-pressure control valve (low-pressure regulator) 5 for the high-pressure gasoline pump 4, and a solenoid valve unit 6. The fuel pump for a high-pressure fuel injection system 1 supplies fuel (gasoline) to injectors 8 through a common rail 7.

The solenoid valve unit 6 has a solenoid valve 9 and a high-pressure control valve (high-pressure regulator) 10, and the solenoid valve 9 is provided with an orifice 11.

The high-pressure control valve 10 and the solenoid valve 9 are connected in parallel between a high-pressure side inlet port 12 and a low-pressure side outlet port 13 of the solenoid valve unit 6. The low-pressure side outlet port 13 communicates with a return connection point 14.

A path from the outlet 15 of the high-pressure gasoline pump 4, through a high-pressure fuel supply pipe 16, the common rail 7 and a high-pressure fuel control pipe 17 to the high-pressure side inlet port 12 of the solenoid valve unit 6 is bypassed by a pump-control valve communication passage 18 connected between the outlet 15 and the high-pressure side inlet port 12. The pump-control valve communication passage 18 has a orifice 19.

In this invention, the high-pressure gasoline pump 4 and the solenoid valve unit 6 are integrated into a pump unit 20.

Figure 2:
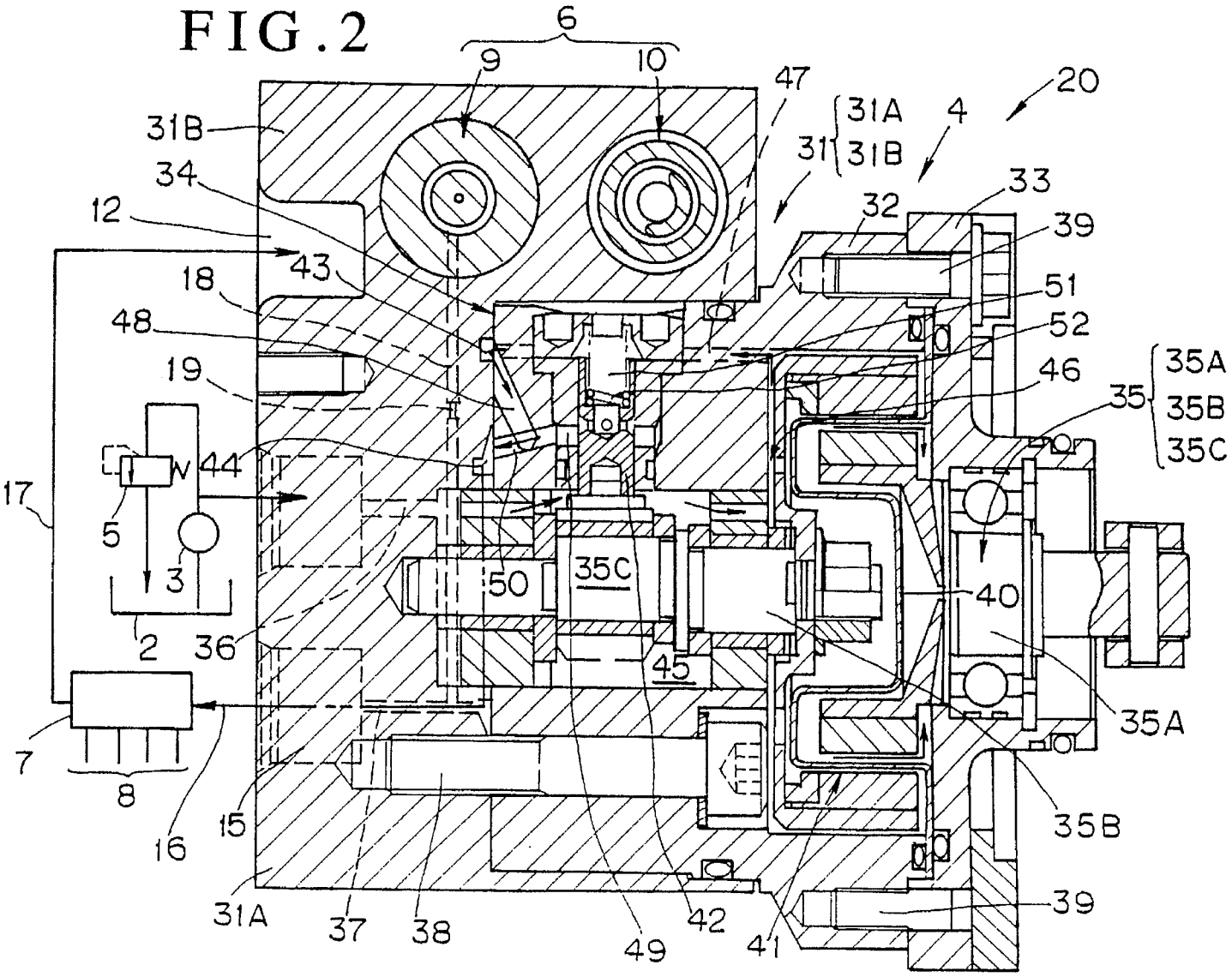
FIG. 2 is a sectional view of the pump unit 20 of the fuel pump for a high-pressure fuel injection system 1, showing a specific configuration of a high-pressure gasoline pump 4 thereof.
Figure 3:
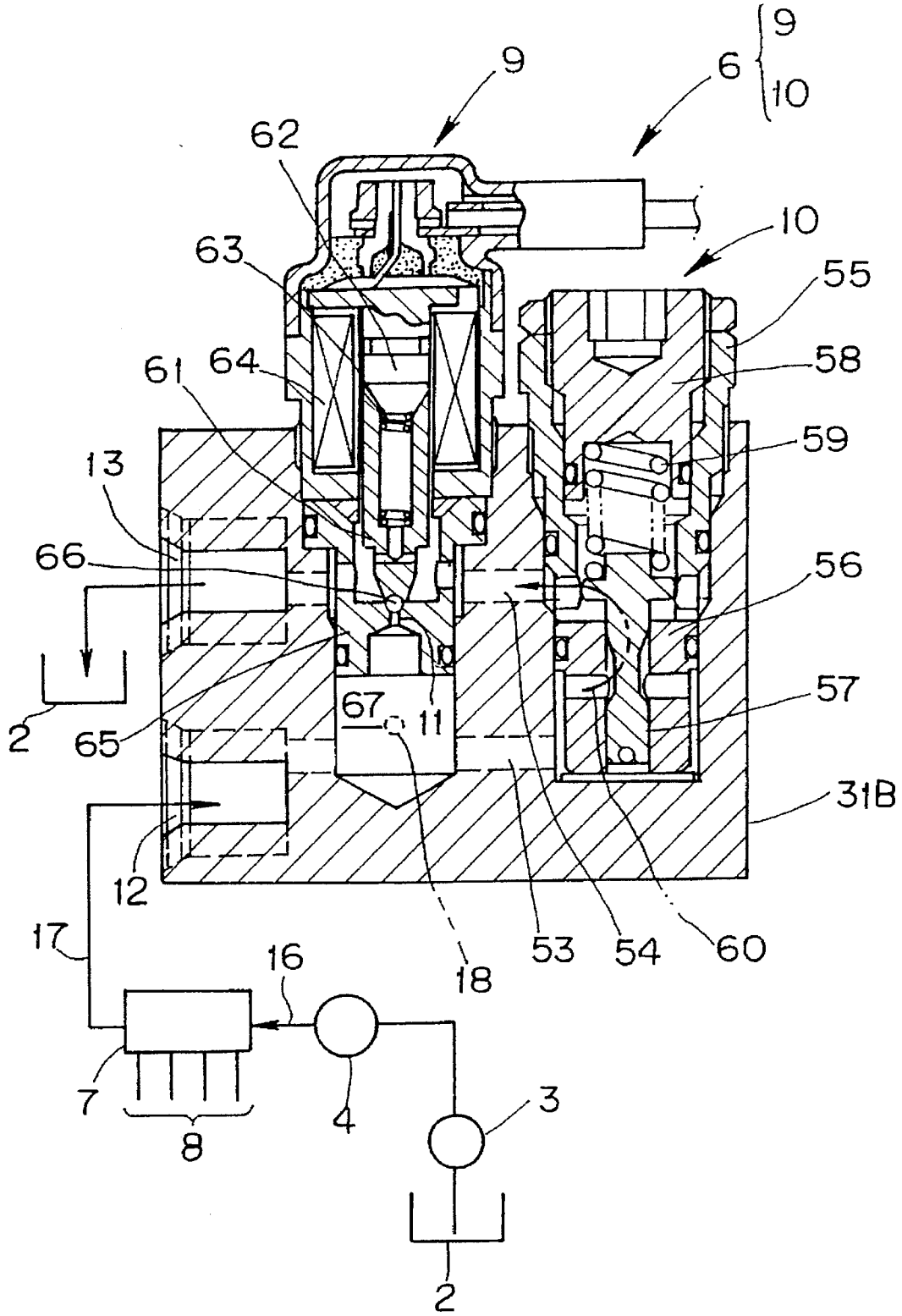
FIG. 3 is a sectional view of the pump unit 20, showing a specific configuration of a solenoid valve unit 6 thereof.

FIG. 2 is a sectional view of the pump unit 20 of the fuel pump for a high-pressure fuel injection system 1, showing a specific configuration of a high-pressure gasoline pump 4 thereof, and FIG. 3 is a sectional view of the pump unit 20, showing a specific configuration of a solenoid valve unit 6 thereof.

The pump unit 20 is the structure obtained by integrating the high-pressure gasoline pump 4 and the solenoid valve unit 6 shown in FIG. 1.

More specifically, the pump unit 20 has a control valve housing 31 constituted by integrating a cover 31A of the high-pressure gasoline pump 4 and a unit housing 31B of the solenoid valve unit 6, a pump housing 32, a flange 33, a leaf valve 34 positioned between the control valve housing 31 and the pump housing 32, and a pump shaft 35 driven by an engine (not shown).

The cover 31A of the control valve housing 31 is formed with an intake passage 36 and an discharge passage 37 and the control valve housing 31 is fastened to the pump housing member 32 by bolts 38. In addition, the pump housing 32 and the flange 33 are fastened together by housing bolts 39.

The pump shaft 35 bridges the pump housing 32 and the flange 33 and is divided into a drive-side shaft 35A and a driven-side shaft 35B which are located on opposite sides of a partition 40 made of a nonmagnetic material. The driven-side shaft 35B is formed with an eccentric cam 35C.

A magnetic coupling 41 is provided between the drive-side shaft 35A and the driven-side shaft 35B. The magnetic coupling 41 straddles the partition 40 and enables power supplied to the drive-side shaft 35A from the engine (not shown) to be transmitted to the driven-side shaft 35B.

Multiple (e.g. five) pistons 42 are provided in the pump housing 32 and are reciprocated in sequence by the eccentric cam 35C of the pump shaft 35.

The pistons 42 are disposed radially within a plane perpendicular to the axis of the pump shaft 35 so that rotation of the pump shaft 35 causes them to reciprocate, namely to move centripetally (downward in FIG. 2) and centrifugally (upward in FIG. 2).

The leaf valve 34 is formed with intake valves 43 and discharge valves 44 (only one of each shown). The pump housing 32 is further formed with a fuel passage starting from the intake passage 36 and passing in succession through a cam chamber 45, a coupling chamber 46, an intake-side communication passage 47 and an intake-side passage 48, and thereafter through an intake/discharge port 49, a discharge-side passage 50, a discharge valve 44 and the discharge passage 37.

Pressurization chambers 51 are formed inside the pistons 42 in communication with the intake/discharge ports 49, and the pistons 42 are urged centripetally by piston springs 52. When the pump shaft 35 is rotated, the pistons operate to intake fuel through the intake valves 43 and discharge it through the discharge valves 44.

As shown in FIG. 3, the solenoid valve unit 6 includes the solenoid valve 9 and the high-pressure control valve 10. The high-pressure side inlet port 12 of the solenoid valve unit 6 is connected with the high-pressure gasoline pump 4 through the high-pressure fuel control pipe 17 and the common rail 7, while the low-pressure side outlet port 13 thereof is connected with the fuel tank 2.

The unit housing 31B is formed with a high-pressure side passage 53 and a low-pressure side passage 54. The high-pressure control valve 10 and the solenoid valve 9 are disposed across these passages.

The high-pressure control valve 10 includes a valve housing 55, a valve seat member 56, a pressure regulation valve body 57, a valve seat housing 58 and a pressure regulation spring 59.

When the pressure from the high-pressure side inlet port 12 becomes excessively high, the pressure regulation valve body 57 is lifted off the valve seat member 56 against the force of the pressure regulation spring 59 so as to connect the high-pressure side passage 53 and the low-pressure side passage 54 through a closable passage 60 formed between the pressure regulation valve body 57 and the valve seat member 56. (The closable passage 60 is indicated by a phantom line in FIG. 5.)

The solenoid valve 9, which provided across the high-pressure side passage 53 and the low-pressure side passage 54, includes an armature 61, a spring seat member 62, a solenoid spring 63, a solenoid 64, a valve seat member 65 and a valve body 66 formed integrally with the armature 61 at the tip thereof. The valve body 66 opens and closes the orifice 11 referred to earlier.

The pump-control valve communication passage 18 opens into a communication space 67 provided to communicate with the high-pressure side passage 53 and the high-pressure side inlet port 12, whereby it communicates the high-pressure side inlet port 12 with the discharge passage 37 (high-pressure pump outlet 15) of the high-pressure gasoline pump 4.

At the time of starting the engine (not shown), the solenoid 64 of the solenoid valve 9 is turned ON to communicate the high-pressure side passage 53 and the low-pressure side passage 54, thereby enabling delivery of pressurized fuel from the low-pressure feed pump 3, not from the high-pressure gasoline pump 4, so that low-pressure fuel can be used during engine starting. Then during normal high-pressure operation following the start of misfire free operation, the solenoid 64 is turned OFF, thereby shutting off communication between the high-pressure side passage 53 and the low-pressure side passage 54 and enabling high-pressure injection using the high-pressure gasoline pump 4. Since this is not directly related to the invention, however, it will not be explained further.

In the fuel pump for a high-pressure fuel injection system 1 of the foregoing configuration, once normal engine operation begins following the start of misfire free operation, the pistons 42 are reciprocated by the rotation of the pump shaft 35 of the high-pressure gasoline pump 4, causing fuel to be sucked in and discharged and thus supplying fuel to the injectors 8 through the discharge passage 37 and the common rail 7.

In the course of this fuel delivery operation, the high-pressure control valve 10 is able to function as a relief valve.

More specifically, if the pressure in the high-pressure gasoline pump 4 should rise to an abnormally high level because the high-pressure fuel supply pipe 16 between the pump unit 20 and the common rail 7 or the high-pressure fuel control pipe 17 becomes blocked for some reason, this pressure is transferred to the high-pressure control valve 10 through the pump-control valve communication passage 18 bypassing the high-pressure fuel supply pipe 16 and the high-pressure fuel control pipe 17, the high-pressure side inlet port 12, the filter installation space 67 and the high-pressure side passage 53, so that the pressure regulation valve body 57 is lifted off the valve seat member 56 against the force of the pressure regulation spring 59, thereby opening the closable passage 60 between the high-pressure side passage 53 and the low-pressure side passage 54 and allowing the abnormal pressure to escape from the low-pressure side outlet port 13 into the fuel tank 2.

It is therefore possible to avoid the danger of an abnormal pressure rise in the high-pressure gasoline pump 4 when a problem arises in the system.

Since the orifice 19 reduces the pump-control valve communication passage 18 to a smaller sectional area than those of the high-pressure fuel supply pipe 16 and the high-pressure fuel control pipe 17, the pump-control valve communication passage 18 does not affect the amount of fuel flowing through the high-pressure gasoline pump 4, the high-pressure fuel supply pipe 16, the common rail 7 and the high-pressure fuel control pipe 17 when the high-pressure gasoline pump 4 is operating normally.

If the sectional area of the pump-control valve communication passage 18 is made adequately small throughout, the orifice 19 is unnecessary.

Since the path for communicating the high-pressure pump outlet 15 with the high-pressure control valve 10 of the solenoid valve unit 6 can be constituted inside the integral control valve housing 31, the system can be fabricated more easily than if the pump-control valve communication passage 18 were provided on the exterior of the control valve housing 31. It is also safer and more effective since there is no possibility of the pump-control valve communication passage 18 being shut off by external pressure.

As utilization of the high-pressure control valve 10 to prevent abnormal pressure rise in the high-pressure gasoline pump 4 eliminates the need for separate installation of a relief valve, moreover, there is no increase in cost.

Another advantage is that since the high-pressure control valve 10 that provides the function of a relief valve exhibits high-precision valve opening pressure, the variance between different high-pressure gasoline pumps 4 manufactured can be kept to a much lower level than in the case where abnormal pressure rise is prevented using a low-precision relief valve or based on step-out of the magnetic coupling 41.

In addition, the fuel pump for a high-pressure fuel injection system according to the invention overcomes the problem of the performance of the high-pressure gasoline pump 4 being degraded by fuel leakage from a relief valve.

The relief pressure of an ordinary relief valve has to be set at 1.1 times (10% higher than) the relief control pressure in order to ensure the required sealing property. This puts an extra load on the components of the high-pressure gasoline pump 4. In contrast, since the high-pressure control valve 10 that provides the function of a relief valve in this invention manifests high-precision valve opening pressure, the relief pressure can be set equal to the relief control pressure. Since performance degradation owing to fuel leakage can therefore be prevented without an added 10% increase in pressure, the components of the high-pressure gasoline pump 4 are not exposed to an overload.

As regards an abnormality that can be electrically detected, a further improvement in safety can be achieved by configuring the system to respond to the detection signal by opening the solenoid valve 9 and thus setting the relief pressure sufficiently lower than the relief control pressure.

As explained in the foregoing, the invention provides a pump-control valve communication passage which connects the high-pressure fuel pump with the high-pressure control valve and bypasses the injectors and the common rail. Since this configuration enables the high-pressure control valve to function as a relief valve, it contributes to cost reduction and also improves performance by avoiding the performance degradation caused by leakage from the relief valve in prior-art systems and thus freeing the high-pressure control valve from excessive load.

What is claimed is:

1. A fuel pump for a high-pressure fuel injection system comprising:

a high-pressure fuel pump for supplying high-pressure fuel to injectors for injecting high-pressure fuel into cylinders of an engine, a pressure control valve for controlling the fuel pressure of the high-pressure fuel pump, a high-pressure fuel supply pipe connecting the high-pressure fuel pump and the injectors, a high-pressure fuel control pipe connecting the injectors and the pressure control valve, and a pump-control valve communication passage formed to communicate the high-pressure fuel pump with the pressure control valve and bypass the injectors, the sectional area of the pump-control valve communication passage being smaller than those of the high-pressure fuel supply pipe and the high-pressure fuel control pipe.

2. A fuel pump for a high-pressure fuel injection system according to claim 1, wherein the pressure control valve is a high-pressure control valve capable of relieving pressure from the pump-control valve communication passage.

3. A fuel pump for a high-pressure fuel injection system according to claim 1, wherein the pump-control valve communication passage is formed between a high-pressure pump outlet of the high-pressure fuel pump and a high-pressure side inlet port of the pressure control valve and bypasses a high-pressure fuel supply pipe leading from the high-pressure pump outlet to the injectors and a high-pressure fuel control pipe leading from the injectors to the pressure control valve.

4. A fuel pump for a high-pressure fuel injection system according to claim 1, wherein the high-pressure fuel pump and the pressure control valve are integrated into a unitary pump unit and the pump-control valve communication passage is formed in a control valve housing of the pump unit.

5. A fuel pump for a high-pressure fuel injection system according to claim 4, wherein the high-pressure control valve is provided in a unit housing portion, a high-pressure pump outlet of the high-pressure fuel pump is provided in a cover, and the unit housing portion and the cover are integrated as a single body.

6. A fuel pump for a high-pressure fuel injection system according to claim 1, wherein the pump-control valve communication passage is formed with an orifice.

7. A fuel pump for a high-pressure fuel injection system according to claim 1, wherein the high-pressure fuel pump is a radial piston pump comprising a pump shaft adapted for rotation by the engine and pistons reciprocated by rotation of the pump shaft.

* * * * *